US010880968B1

(12) United States Patent
Zhou et al.

(10) Patent No.: US 10,880,968 B1
(45) Date of Patent: Dec. 29, 2020

(54) INDEPENDENT, MULTIPLE CHANNEL LED DRIVER FOR CONTROL OF CORRELATED COLOR TEMPERATURE

(71) Applicant: Cuvee Systems, Inc., San Jose, CA (US)

(72) Inventors: Dongsheng Zhou, Cupertino, CA (US); Kin Chan, Dublin, CA (US); Raymond Chock, San Jose, CA (US)

(73) Assignee: Cuvee Systems, Inc., San Jose, CA (US)

( * ) Notice: Subject to any disclaimer, the term of this patent is extended or adjusted under 35 U.S.C. 154(b) by 0 days.

(21) Appl. No.: 16/598,321

(22) Filed: Oct. 10, 2019

(51) Int. Cl.

| | |
|---|---|
| ***H05B 39/00*** | (2006.01) |
| ***H05B 41/00*** | (2006.01) |
| ***H05B 45/37*** | (2020.01) |
| ***H05B 45/10*** | (2020.01) |
| ***H05B 45/20*** | (2020.01) |

(52) U.S. Cl.
CPC ..... *H05B 45/37* (2020.01); *H05B 45/10* (2020.01); *H05B 45/20* (2020.01)

(58) Field of Classification Search
CPC .... H05B 41/34; H05B 33/0803; H05B 39/09; H05B 41/28; H05B 33/0809; H05B 41/295; H05B 41/2827; H05B 41/3925; H05B 33/0815; H05B 33/0818; H05B 41/2828; H05B 41/3921; H05B 41/3927; H05B 37/029; H05B 37/02; H05B 37/0254; H05B 33/0827; H05B 33/0851; H05B 45/37; H05B 45/10; H05B 45/20; H05B 41/36; H05B 41/00; Y02B 20/202; F21Y 2101/02; H01J 19/80; H01J 25/18; H01J 25/04; H01J 21/10; H01J 23/38; H01J 61/52; H01J 65/044; H01J 61/523; H01J 13/32; F21K 9/00; F21V 29/004
See application file for complete search history.

(56) References Cited

U.S. PATENT DOCUMENTS

| | | | | |
|---|---|---|---|---|
| 2015/0091464 | A1* | 4/2015 | Yagi | H05B 33/086 315/201 |
| 2015/0188631 | A1* | 7/2015 | Harbers | H05B 33/0803 398/119 |
| 2015/0351190 | A1* | 12/2015 | Walters | H05B 33/0815 315/186 |
| 2018/0110102 | A1* | 4/2018 | Adams | F21V 5/04 |
| 2019/0297701 | A1* | 9/2019 | Cao | H05B 33/086 |

* cited by examiner

*Primary Examiner* — Minh D A
(74) *Attorney, Agent, or Firm* — Spano Law Group; Joseph S. Spano

(57) ABSTRACT

Methods and systems for improved control of dimmable, white color tunable, multiple channel LED based illumination systems are described herein. The methods and systems described herein improve the utilization of LEDs comprising a multiple channel white light LED based illumination system, along with improved control of brightness and color of emitted light. In one aspect, a multiple channel electrical power driver includes an independent current controlled Direct Current/Direct Current (DC/DC) electrical power converter electrically coupled to each LED string having a different color output. The use of independent DC/DC power converters enables current to be supplied to each LED channel simultaneously up to the rated maximum continuous operating current level in each channel. Thus, the sum of the current provided to each LED channel exceeds the rated maximum continuous operating current of each of the LED channels.

14 Claims, 7 Drawing Sheets

MEM
145

| | $LUMEN_1$ | $LUMEN_2$ | | $LUMEN_J$ | | $LUMEN_N$ |
|---|---|---|---|---|---|---|
| $CCT_1$ | $\{I_{2700}, I_{6500}\}^{1,1}$ | $\{I_{2700}, I_{6500}\}^{1,2}$ | • • • | $\{I_{2700}, I_{6500}\}^{1,J}$ | • • • | $\{I_{2700}, I_{6500}\}^{1,N}$ |
| $CCT_2$ | $\{I_{2700}, I_{6500}\}^{2,1}$ | $\{I_{2700}, I_{6500}\}^{2,2}$ | • • • | $\{I_{2700}, I_{6500}\}^{2,J}$ | • • • | $\{I_{2700}, I_{6500}\}^{2,N}$ |
| • | • | • | | • | | • |
| • | • | • | | • | | • |
| • | • | • | | • | | • |
| • | • | • | | • | | • |
| $CCT_I$ | $\{I_{2700}, I_{6500}\}^{I,1}$ | $\{I_{2700}, I_{6500}\}^{I,2}$ | • • • | $\{I_{2700}, I_{6500}\}^{I,J}$ | • • • | $\{I_{2700}, I_{6500}\}^{I,N}$ |
| • | • | • | | • | | • |
| • | • | • | | • | | • |
| • | • | • | | • | | • |
| • | • | • | | • | | • |
| $CCT_M$ | $\{I_{2700}, I_{6500}\}^{M,1}$ | $\{I_{2700}, I_{6500}\}^{M,2}$ | • • • | $\{I_{2700}, I_{6500}\}^{M,J}$ | • • • | $\{I_{2700}, I_{6500}\}^{M,N}$ |

FIG. 5

INDEPENDENT, MULTIPLE CHANNEL LED DRIVER FOR CONTROL OF CORRELATED COLOR TEMPERATURE

TECHNICAL FIELD

The described embodiments relate to multiple channel electrical power conversion and control, and more specifically, to electrical power conversion and control for solid state lighting devices with adjustable correlated color temperature.

BACKGROUND INFORMATION

Light emitting diode (LED) based illumination devices have emerged as a preferred technology for general illumination. The high efficiency of LEDs reduces electrical power consumption, making LEDs an environmentally attractive lighting solution. In many examples, municipalities at the city, state, and national level have enacted regulations requiring a transition from the use of incandescent light bulbs to LED based lighting devices.

Although incandescent bulbs are undesirable from the point of view of efficiency, the quality of light generated by incandescent bulbs is relatively high. By itself, a single LED device is a narrowband emitter having relatively poor color rendering characteristics. To address this deficiency manufacturers have offered a number of solutions. In some examples, LEDs are arranged in combination with light converting phosphor materials to generate general (i.e., white) illumination light having broadband spectral characteristics. In some examples, LEDs of different colors are arranged in combination to generate general illumination light having broadband spectral characteristics.

For general illumination, devices including one or more LEDs arranged in combination with light converting phosphor materials generating illumination light at a target color point near the black body curve have proven to be a commercially acceptable lighting solution. Although single color point illumination devices have proven to be cost effective and commercially successful, there is a growing trend in the development of LED based illumination devices with adjustable color point. Illumination sources with adjustable color point allow an illumination device to generate light with different aesthetic features.

In some examples, the Correlated Color Temperature (CCT) of an LED based illumination device is adjustable. In this manner, the an LED based illumination device can be configured to emit "warm" light having a relatively low CCT that mimics a sunrise or sunset, and can also be configured to emit "cool" light having a relatively high CCT that mimics daylight conditions.

Currently, an LED based illumination device with tunable CCT is most cost effectively achieved by fabricating at least two separate LED circuits, each emitting a different color. The CCT of the light emitted from the LED based illumination device is adjusted by controlling the electrical power supplied to each different LED circuit.

In many examples, an electrical power driver supplies electrical power to a two channel LED based illumination device in a complementary manner. In some examples, an electrical power driver generates two complementary pulse width modulation (PWM) signals. When one signal is high (on), the other signal is low (off), and vice-versa. A PWM signal has a period ($T_s$) and a pulse width ($T_{on}$), which is adjustable to any desired fraction of the period. The PWM signal is high during $T_{on}$. The PWM signal is low for the remainder of the cycle period ($T_s-T_{on}$). The complementary PWM signal is generated by processing the PWM signal through a logic inverter. In this manner, the inverted PWM signal is low during $T_{on}$ and high during for the remainder of the cycle period ($T_s-T_{on}$). In this manner, the inverted PWM signal is complementary to the PWM signal, i.e., only one channel of the two channel LED based illumination device may be "on" at any given time. The PWM signal controls current flow through an LED circuit and the inverted PWM signal controls current flow through another LED circuit that emits light having a different color. The average CCT of the light emitted from the two LED circuits is tuned by controlling the ratio of on-time between the two LED circuits.

FIG. 1 depicts an illustration of a traditional multichannel LED driver in one embodiment. FIG. 1 depicts LED strings 105A and 105B. Each LED string includes a number of LEDs electrically coupled in series. LED string 105A emits white light with a different CCT than LED string 105B. A single stage current controlled Alternating Current/Direct Current (AC/DC) converter 120 generates a controlled current employed to provide current 113 to power LED strings 105A and 105B and current 119 to power controller 108. AC line power 110 is received across input nodes, L, and N, of input filter 101. Input filter 101 protects the source of AC line power from unwanted electromagnetic interference by effectively blocking unwanted power spikes that may be generated by the AC/DC converter 120. Filtered AC line power 111 is transmitted to rectifier 102. In one embodiment, rectifier 102 is a diode bridge that rectifies the filtered AC voltage into a one directional half sine wave voltage signal 112. Power factor correction converter 103 is a switched mode isolated flyback converter that includes a primary side that generates a sine wave input current in phase with the rectified voltage signal 112. This helps to achieve a high power factor (PF) and effective power factor correction (PFC). Power factor correction converter 103 also includes a secondary side that generates a controlled output current based on a command signal 117 received from controller 108. Bulk capacitor 104 filters out high frequency current components induced by switching elements of power factor correction converter 103 from the current 119 supplied to controller 108 and current 113 supplied to LED strings 105A or 105B.

Controller 108 controls the average color of light emitted from LED strings 105A and 105B by controlling the ratio of time current 113 flows through LED string 105A versus the time current 113 flows through LED string 105B. At no time does current flow through both LED strings 105A and 105B simultaneously. Controller 108 receives a color command signal 116 including an indication of a desired CCT of the average color of light to be emitted from LED strings 105A and 105B. Based on the value of the color command signal, controller 108 determines a desired ratio of time current 113 should flow through LED string 105A versus the time current 113 should flow through LED string 105B. Controller 108 generates a pulse width modulated (PWM) signal 118 that is communicated directly to switching element 106A. In some examples, controller 108 generates PWM signal 118 such that the duty cycle of PWM signal 118 (i.e., ratio of time PWM signal 118 is in a high state versus time PWM signal is in a low state) matches the desired ratio of time current 113 should flow through LED string 105A versus the time current 113 should flow through LED string 105B. In addition, PWM signal 118 is communicated to inverter 107. Inverter 107 generates PWM signal 121, which is the inverse of PWM signal 118. Thus, when PWM signal 118 is high, PWM signal 121 is low, and vice-versa. Signal 121 is communicated to switching element 106B. In this manner, when switching element 106A is substantially conductive, switching element 106B is substantially non-conductive, and vice-versa, based on the state of PWM signal 118 and its inverse, PWM signal 121. When switching element 106A is substantially conductive, LED string 105A is effectively coupled to an electrical ground node 114, inducing current 113 to flow through LED string 105A. Similarly, when switching element 106B is substantially conductive, LED string 105B is effectively coupled to electrical ground node 114, inducing current 113 to flow through LED string 105B. In this manner, controller 108 controls the average color (i.e., CCT) of light emitted by LED strings 105A and 105B by controlling the duty cycle of PWM signal 118, and thus the ratio of time current 113 flows through LED string 105A versus the time current 113 flows through LED string 105B.

In addition, controller 108 controls the average lumen output of light emitted from LED strings 105A and 105B by controlling the value of current 113 available to flow through LED string 105A or LED string 105B. In the embodiment depicted in FIG. 1, controller 108 communicates brightness command signal 117 to power factor correction converter 103 via isolation module 109. Isolation module electrically isolates the power factor correction converter 103 from controller 108 to prevent any human interaction with high voltages that may be present at power factor correction converter 103 and prevent any spurious spikes in electrical power from damaging controller 108. Power factor correction converter 103 receives the brightness command signal 117 indicative of a desired current flow 113 available to LED string 105A or 105B. In turn, power factor correction converter 103 adjusts its output current to achieve the desired current flow, and consequently adjusts the input current flow 110 from the AC power source. In this manner, an adjustment in value of the brightness command signal changes the electrical power draw of the AC/DC converter 120 from the AC power source.

In some embodiments, controller 108 is implemented in analog format to minimize cost. In these embodiments, brightness command signal 115 and color command signal 116 are analog signals (e.g., signals communicated via a standard 0-10 Volt interface) received by controller 108. In turn, controller 108 generates PWM command signal 118 based on color command signal 116 and brightness command signal 117 based on brightness command signal 115. In some examples brightness command signal 117 is a PWM signal. In some other examples, brightness command signal 117 is an analog signal. In some embodiments, isolation module 108 is implemented to transform brightness command signal 117 optically or magnetically to realize electrical isolation between controller 108 and power factor correction converter 103.

In some embodiments, controller 108 is implemented in digital format. In these embodiments, brightness command signal 115 and color command signal 116 are digital signals (e.g., signals communicated via a standard digital interface such as digital addressable lighting interface (DALI) or a wireless communication interface such as WIFI or Bluetooth low energy (BLE)) received by controller 108.

The traditional multichannel LED driver depicted in FIG. 1 suffers from a number of disadvantages. The use of a single stage AC/DC converter results in an undesirable noise component of the output current 113 provided to the LEDs at twice the frequency of the fundamental frequency of the AC line power 110. Although, bulk capacitor 104 partially attenuates this signal, practically sized bulk capacitors are limited in their ability to significantly attenuate this noise source. In the United States, this appears as a 120 Hz ripple on the light output generated by LED strings 105A or 105B. In many parts of Europe and Asia, this appears as a 100 Hz ripple on the light output generated by LED strings 105A and 105B. In addition, the light output generated by LED strings 105A and 105B is contaminated with other frequency components arising from switching elements 106A and 106B. These frequency components are not synchronized to the AC line frequency, and the interaction among these different frequencies may generate sub-harmonics that are visible to the human eye.

Another disadvantage associated with the use of a single stage AC/DC converter is the operation of the converter in a constant current mode with current draw from both LED strings 105A or 105B and controller 108. The current draw of controller 108 may range from 10 milliamps to 50 milliamps. At relatively high current levels, this parasitic draw does not introduce a large error between the brightness of the average light generated by LED strings 105A and 105B and the commanded brightness 117. However, at relatively low current levels (e.g., deep dimming), this parasitic draw does introduce a large error between the brightness of the average light generated by LED strings 105A and 105B and the commanded brightness 117. This results in difficulty achieving deep dimming with any accuracy.

FIG. 2 depicts an illustration of a traditional multichannel LED driver in another embodiment. Common reference numbers present in FIG. 1 and FIG. 2 refer to analogous structures as described with reference to FIG. 1. In the embodiment depicted in FIG. 2 a voltage controlled Alternating Current/Direct Current (AC/DC) converter 129 is electrically coupled to a DC/DC power converter 130, which is in turn coupled to both LED strings 105A and 105B. In this embodiment, the LED driver is a two stage power converter, including AC/DC converter 129 and DC/DC power converter 130. Unlike the embodiment depicted in FIG. 1, power factor correction converter 125 operates in a constant output voltage mode to provide a controlled supply voltage 128 on bulk capacitor 126. Power factor correction converter 125 maintains supply voltage 128 at a constant, controlled level for different current levels by adjusting the electrical power drawn from the AC power source.

In the embodiment depicted in FIG. 2, DC/DC power converter 130 is a switched mode DC/DC converter configured to operate in a controlled current mode. DC/DC power converter 130 generates a controlled current 131 that flows through LED string 105A or LED string 105B, but never both simultaneously. Since DC/DC power converter 130 draws electrical power from bulk capacitor 126, it is able to generate controlled current output 131 without noise components at twice the AC line frequency.

As depicted in FIG. 2, controller 108 draws electrical power 127 from bulk capacitor 126 as well without diverting any current from the output of DC/DC power converter 130. As a result, DC/DC power converter 130 is able to control the current flow 131 through LED string 105A or LED string 105B accurately at low current levels (i.e., low dim levels).

Controller 108 controls the average color of light emitted from LED strings 105A and 105B by controlling the ratio of time current 131 flows through LED string 105A versus the time current 131 flows through LED string 105B as described with reference to FIG. 1. In addition, controller 108 controls the average lumen output of light emitted from LED strings 105A and 105B by controlling the value of current 131 available to flow through LED string 105A or LED string 105B. In the embodiment depicted in FIG. 2, controller 108 communicates brightness command signal 117 indicative of a desired value of output current to DC/DC power converter 130. In response, DC/DC power converter 130 adjusts output current 131 to match the desired value.

Unfortunately, both the multichannel LED drivers depicted in FIGS. 1 and 2 have a number of limitations. As described with reference to FIG. 1, at any given time current flows through one of the LED strings. Typically, a multiple channel white LED illumination device includes a cool colored LED string and a warm colored LED string with comparable current ratings to achieve comparable brightness across the entire CCT tuning range, especially comparable brightness at both ends of the achievable CCT range. By limiting current flow to one LED string at a given time, it is not possible to drive both LED strings at their rated current simultaneously. This underutilizes the LEDs. Under typical system operating conditions, the LEDs of systems such as those described with reference to FIG. 1 and FIG. 2 are underutilized by about 25%. LED cost is typically half of the cost of the entire LED based illumination system. Thus, the underutilization of LEDs negatively impacts system cost.

Another limitation of traditional multiple channel LED drivers is the finite delay of the inverter 107 employed to invert the PWM control signal 118. Inverter 107 has finite delay. As a result, the transition of switching element 106B is always delayed relative to the transition of switching element 106A. As a result, there is a time when both switching elements 106A and 106B are "off", causing an abrupt halt to the driving current supplied by the driver. This abrupt disruption to the output current of the driver introduces error to either the "on" time or the current magnitude of both LED strings. At high brightness levels, these errors are relatively small, but at low (dim) brightness levels, these errors are significant. In some examples, the actual CCT at low brightness levels differs significantly from the commanded value. The errors in brightness and CCT introduced at low light levels depend on both brightness level and the ratio of "on" times between the LED strings. It is a challenge to find a cost effective way to compensate this varying error even with extensive calibration.

In summary, it is desirable to improve LED utilization and accuracy of color and brightness control of multiple channel white LED illumination systems.

SUMMARY

Methods and systems for improved control of dimmable, white color tunable, multiple channel white light LED based illumination systems are described herein. More specifically, the methods and systems described herein improve the utilization of LEDs comprising a multiple channel white light LED based illumination system. Furthermore, the methods and systems described herein enable improved control of brightness and color of emitted light.

In one aspect, a multiple channel electrical power driver includes an independent current controlled Direct Current/Direct Current (DC/DC) electrical power converter electrically coupled to each LED string having a different color output. In addition, the multiple channel electrical power driver includes a controller that generates and communicates independent current command signals to each current controlled DC/DC electrical power converter to achieve a desired brightness and correlated color temperature (CCT) of light generated by the combination of the independently controlled LED strings.

The use of independent DC/DC power converters as described herein enables current to be supplied to each LED string simultaneously up to the rated maximum continuous operating current level in each string. Thus, the sum of the current provided to each LED channel exceeds the rated maximum continuous operating current of each of the LED channels.

In general, the efficacy of an LED varies as a function of current flow through the LED. At lower currents, LED efficacy increases, and vice-versa. In some embodiments, the lumen output and CCT of combined light emitted from an LED based illumination device including two different white color channels (i.e., sets of different white colored LEDs) is measured at different current levels for each channel. The measurement results are employed to create a mapping between desired light characteristics (i.e., lumen output and CCT) and current through each set of LEDs.

In some embodiments, the mapping is implemented as a look-up table employed to determine commanded current values that will result in the desired brightness and lumen output of the resulting combined illumination light. Interpolation, extrapolation, or both, may be employed to determine current levels associated with desired brightness and CCT levels that are not exactly enumerated in the look-up table. In some other embodiments, the mapping is implemented as a mathematical function, or piece-wise set of mathematical functions.

In a further aspect, the multiple channel electrical power driver includes a voltage controlled Alternating Current/Direct Current (AC/DC) electrical power converter electrically coupled to each independent current controlled DC/DC electrical power converter. The voltage controlled AC/DC electrical power converter generates a controlled voltage output to provide electrical power to each of the current controlled DC/DC electrical power converters and the controller.

In another further aspect, a multiple channel electrical power driver is configured to control the combined light generated by multiple, different white colored LED strings in one of a number of different control modes.

In an unconstrained mode, the values of the current command signals are determined to achieve any desired brightness and CCT within the limits of a maximum power curve. In a constant power mode, the values of the current command signals are determined to achieve any desired brightness and CCT within the limits of a constant power curve. In a constant lumen mode, the values of the current command signals are determined to achieve any desired brightness and CCT within the limits of a constant lumen curve. In a dim to warm mode, the values of the current command signals are determined to realize the desired brightness value at a predetermined CCT value. The predetermined CCT value is a function (e.g., linear or non-linear function) of the desired brightness. In some examples, the functional relationship between CCT and brightness mimics daylight. During the day sunlight appears cooler at peak brightness (e.g., middle of the day) and warmer at waning brightness levels (e.g., sunrise and sunset).

In a time of day mode, the values of the current command signals are determined to realize the desired brightness value at a predetermined CCT value. The predetermined CCT value is a function (e.g., linear or non-linear function) of the time of day and calendar date or time of day, calendar date, and physical location.

The foregoing is a summary and thus contains, by necessity, simplifications, generalizations and omissions of detail; consequently, those skilled in the art will appreciate that the summary is illustrative only and is not limiting in any way. Other aspects, inventive features, and advantages of the devices and/or processes described herein will become apparent in the non-limiting detailed description set forth herein.

BRIEF DESCRIPTION OF THE DRAWINGS

FIG. 5 depicts and illustration of an amount of memory 145 storing a look up table that maps desired color and brightness values to commanded drive currents associated with two different colored sets of LEDs.

DETAILED DESCRIPTION

Reference will now be made in detail to background examples and some embodiments of the invention, examples of which are illustrated in the accompanying drawings.

Methods and systems for improved control of dimmable, white color tunable, multiple channel white light LED based illumination systems are described herein. More specifically, the methods and systems described herein improve the utilization of LEDs comprising a multiple channel white light LED based illumination system. Furthermore, the methods and systems described herein enable improved control of brightness and color of emitted light.

In one aspect, a multiple channel electrical power driver includes an independent current controlled Direct Current/Direct Current (DC/DC) electrical power converter electrically coupled to each LED string having a different color output. In addition, the multiple channel electrical power driver includes a controller that generates and communicates independent current command signals to each current controlled DC/DC electrical power converter to achieve a desired brightness and correlated color temperature (CCT) of light generated by the combination of the independently controlled LED strings.

In a further aspect, the multiple channel electrical power driver includes a voltage controlled Alternating Current/Direct Current (AC/DC) electrical power converter electrically coupled to each independent current controlled DC/DC electrical power converter. The voltage controlled AC/DC electrical power converter generates a controlled voltage output to provide electrical power to each of the current controlled DC/DC electrical power converters and the controller.

Figure 2:
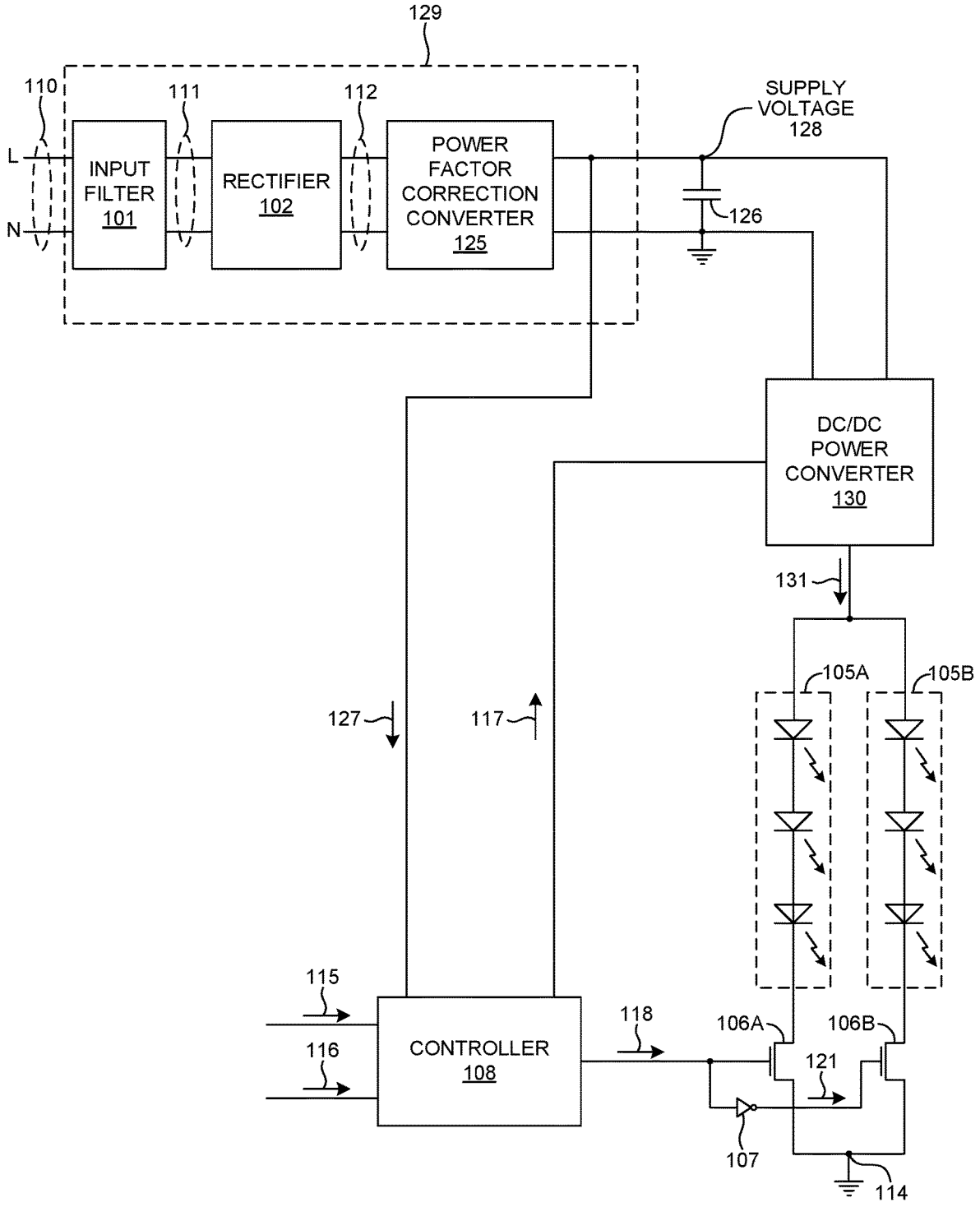
(PRIOR ART) FIG. 2
FIG. 2 is a diagram illustrative of a traditional multichannel LED driver in another embodiment.
Figure 3:
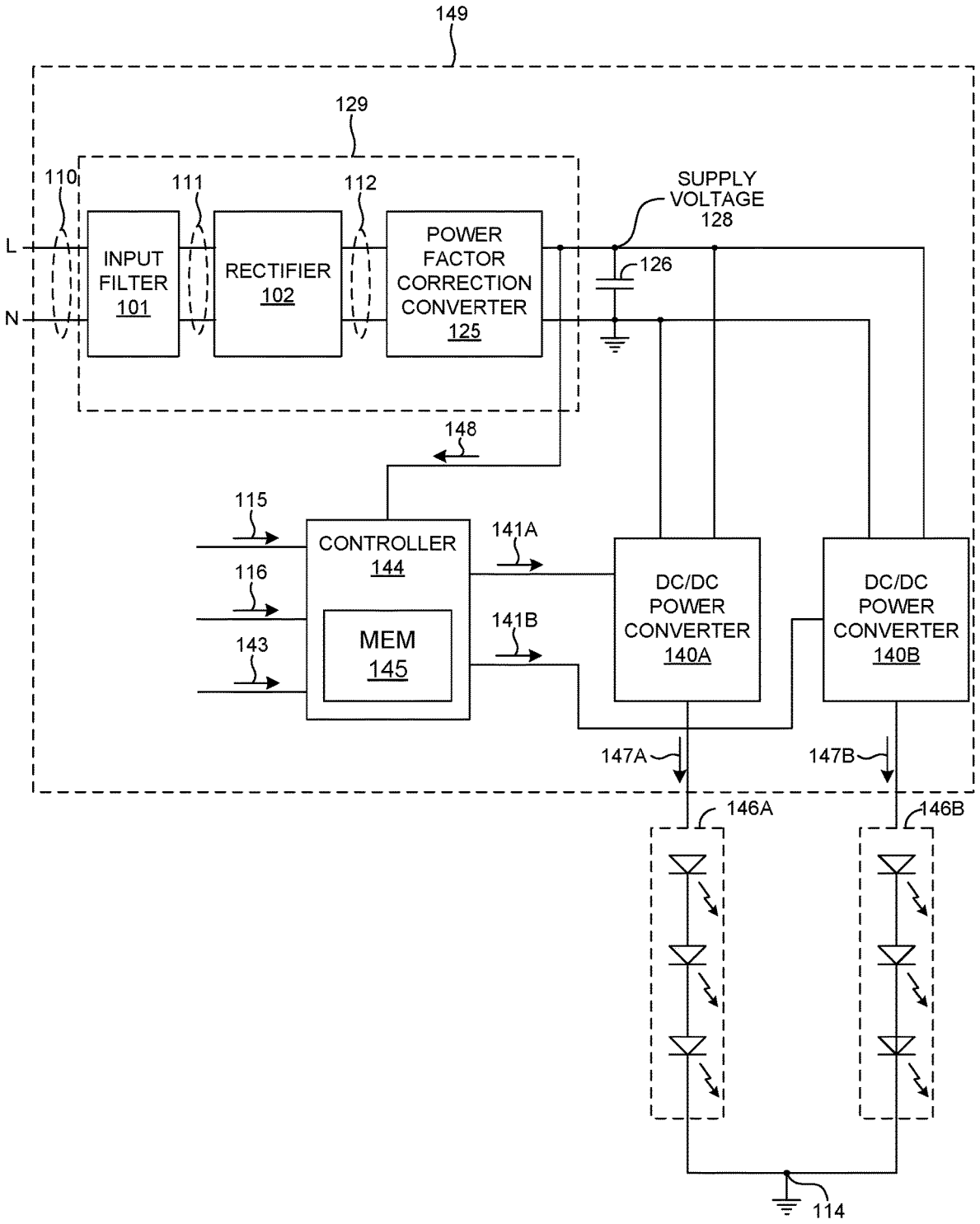
FIG. 3 depicts a diagram illustrative of an independent, multiple channel LED driver in at least one novel aspect.

FIG. 3 depicts an illustration of an embodiment of a multiple channel electrical power driver 149 in at least one novel aspect. Common reference numbers present in FIGS. 1-3 refer to analogous structures as described with reference to FIGS. 1 and 2. FIG. 3 depicts LED strings 146A and 146B. As depicted in FIG. 3, each LED string includes a number of LEDs electrically coupled in series. However, in general, and for purposes of this patent document, an LED string includes any combination of one or more LEDs electrically coupled in series, parallel, or a combination thereof. LED string 146A emits white light with a different CCT than LED string 146B. The light emitted from LED string 146A is combined (i.e., mixed) with light emitted from LED string 146B to generate a combined light emitted by the LED based illumination device. In this manner, the CCT of the light emitted by the LED based illumination device lies within a range of CCTs from the CCT of light emitted by LED string 146A and the CCT of light emitted by LED string 146B.

Each LED string is electrically coupled to an independent, current controlled Direct Current/Direct Current (DC/DC) electrical power converter. As depicted in FIG. 3, current controlled DC/DC electrical power converter 140A is electrically coupled to LED string 146A and provides current 147A to LED string 146A. Similarly, current controlled DC/DC electrical power converter 140B is electrically coupled to LED string 146B and provides current 147B to LED string 146B. Because current controlled DC/DC electrical power converters 140A-B are controlled independently, in many operational scenarios, currents 147A-B flow simultaneously through LED strings 146A-B, respectively.

As depicted in FIG. 3, voltage controlled AC/DC electrical power converter 129 is electrically coupled to both DC/DC electrical power converters 140A and 140B. The voltage controlled AC/DC electrical power converter 129 generates a controlled voltage output 128 to provide electrical power to each of the current controlled DC/DC electrical power converters 140A and 140B, and controller 144. Although a specific voltage controlled AC/DC electrical power converter 129 is described herein, in general, any suitable voltage controlled electrical power source may be contemplated within the scope of this patent document.

Controller 144 receives electrical power 148 from AC/DC electrical power converter 129 to power on-board electrical circuitry. In addition, controller 144 generates current command signal 141A communicated to DC/DC power converter 140A and generates current command signal 141B communicated to DC/DC power converter 140B.

Controller 144 generates current command signals 141A and 141B based on brightness command signal 115, correlated color temperature (CCT) command signal 116, or both. DC/DC power converter 140A receives current command signal 141A indicative of a desired value of current flow 147A through LED string 146A. In response, DC/DC power converter 140A adjusts the value of current 147A to match the desired value. Similarly, DC/DC power converter 140B receives current command signal 141B indicative of a desired value of current flow 147B through LED string 146B. In response, DC/DC power converter 140B adjusts the value of current 147B to match the desired value.

In general, controller 144 controls the color of the combined light emitted from LED strings 146A and 146B at any given instance by controlling the ratio of current 147A and 147B at the given instance. Controller 144 controls the lumen output of the combined light emitted from LED strings 146A and 146B by controlling the sum of currents 147A and 147B.

In some embodiments, controller 144 is a digital controller. In some of these embodiments controller 144 receives brightness control signal 115, color control signal 116, mode control signal 143, or any combination thereof in analog format. In these embodiments, controller 144 includes analog to digital conversion electronics to receive the analog signals and convert the received signals to digital signals. In some of these embodiments controller 144 receives brightness control signal 115, color control signal 116, mode control signal 143, or any combination thereof in digital format. In these embodiments, controller 144 includes one or more digital communication ports to receive the digital command signals in accordance with a standard protocol (e.g., serial interface, DALI interface, etc.). In some of these embodiments, the digital command signals are communicated wirelessly. In these embodiments, controller 144 includes an antenna and radio receiver configured to receive the command signals in accordance with a standard wireless communications protocol (e.g., WIFI or Bluetooth low energy).

In addition, controller 144 is configured to communicate current command signals 141A-B as analog signals, PWM signals, or a combination thereof.

In some embodiments, controller 144 generates a PWM signal indicative of the value of the desired current for each output channel and communicates current command signals 141A and 141B as PWM signals. The pulse width and frequency of a logic level PWM signal is accurately generated by digital controller 144. The response of DC/DC power converters 140A and 140B to the PWM command signals 141A and 141B, respectively, is quite linear over the entire range of output current. However, to achieve a linear response over the entire output current range, DC/DC power converters 140A and 140B require quite large output capacitors to average out high energy ripple. This results in undesirable cost and physical size. In addition, current switching (i.e., on/off) at values of the output current near or at the rated current output of the DC/DC converter contributes to high electromagnetic interference. For these reasons it is not preferred to control DC/DC power converters with PWM signals throughout the output current range.

Figure 6:
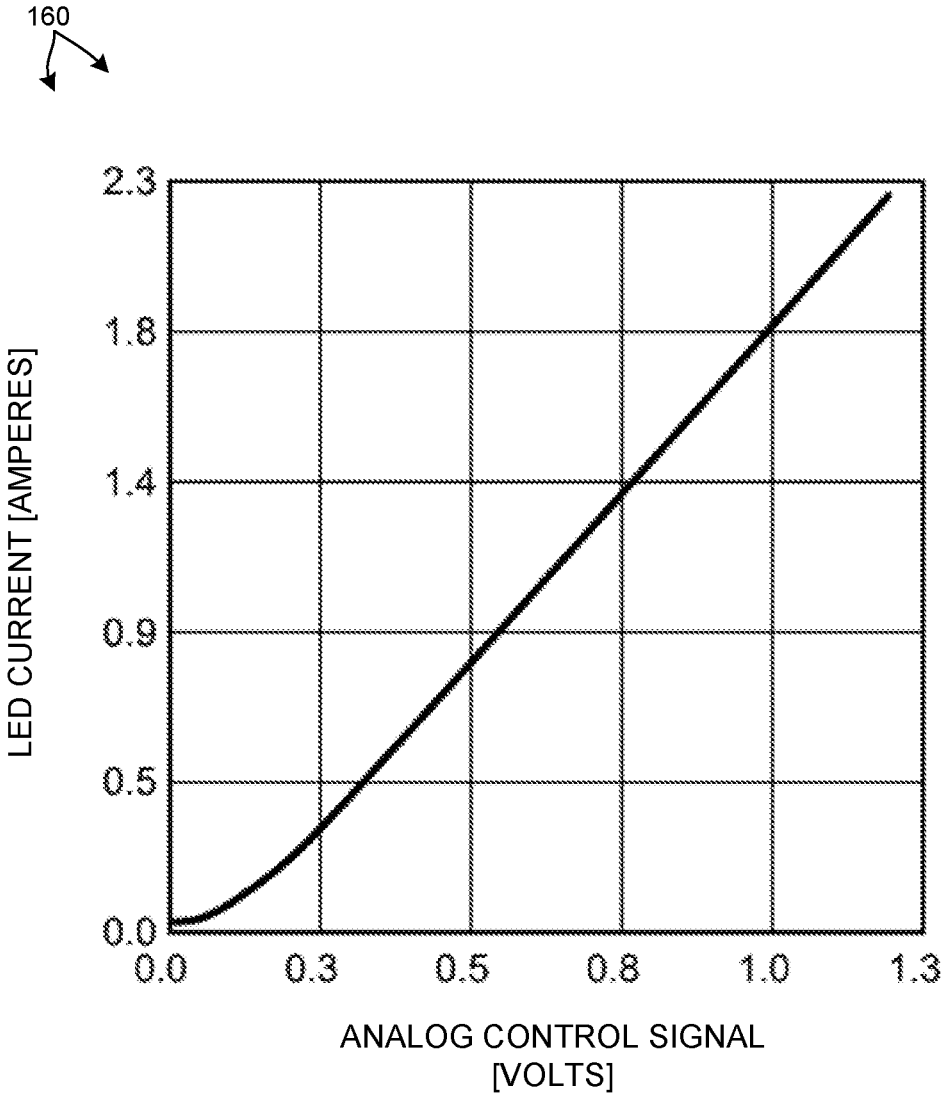
FIG. 6 depicts a plot 160 illustrating the relationship between current flow through an LED as a function of values of an analog current command signal communicated to a current controlled DC/DC converter.

In some embodiments, controller 144 includes a low pass filter at each output channel. The low pass filter is employed to average each PWM command signal communicated to the DC/DC power converters 140A and 140B. The filtered command signals are effectively analog signals. FIG. 6 depicts a plot 160 illustrating the relationship between current flow through an LED as a function of values of an analog current command signal communicated to a current controlled DC/DC converter, such as DC/DC power converters 140A and 140B. As depicted in FIG. 6, at high brightness, the output current responds linearly with value of the analog current command signal. However, when the analog current command signal is less than approximately 20% of the rated output current, the output current does not respond to the value of the analog current command signal in a linear manner. This creates errors between the desired current level and the actual output current level at relatively low output current levels. For these reasons it is not preferred to control DC/DC power converters with analog signals throughout the output current range.

In preferred embodiments, controller 144 is configured to generate current command signals 141A and 141B in analog format above a threshold value of commanded current and in PWM format below the threshold value of commanded current. The predetermined threshold value may be any suitable value, e.g., 30% of the rated output current of the DC/DC converter, 50% of the rated output current of the DC/DC converter, etc.).

In general, the efficacy of an LED varies as a function of current flow through the LED. At lower currents, LED efficacy increases, and vice-versa. In some embodiments, the lumen output and CCT of combined light emitted from an LED based illumination device including two different white color channels (i.e., sets of different white colored LEDs) is measured at different current levels for each channel. The measurement results are employed to create a mapping between desired light characteristics (i.e., lumen output and CCT) and current through each set of LEDs.

In some embodiments, the mapping is implemented as a look-up table stored in memory 145 of controller 144. FIG. 5 depicts and illustration of a look-up table stored in memory 145. As depicted in FIG. 5, the current flow through a warm colored LED string (e.g., an LED string having a CCT of 2,700K) and the current flow through a cool colored LED string (e.g., an LED string having a CCT of 6,500K) is specified for a desired CCT and lumen output level. Interpolation, extrapolation, or both, may be employed by controller 144 to determine current levels associated with desired brightness and CCT levels that are not exactly enumerated in the look-up table. In this manner, controller 144 is able to determine commanded current values that will result in the desired brightness and lumen output of the resulting combined illumination light with the highest accuracy.

In some other embodiments, the mapping is implemented as a mathematical function, or piece-wise set of mathematical functions stored in memory 145 of controller 144.

Figure 4:
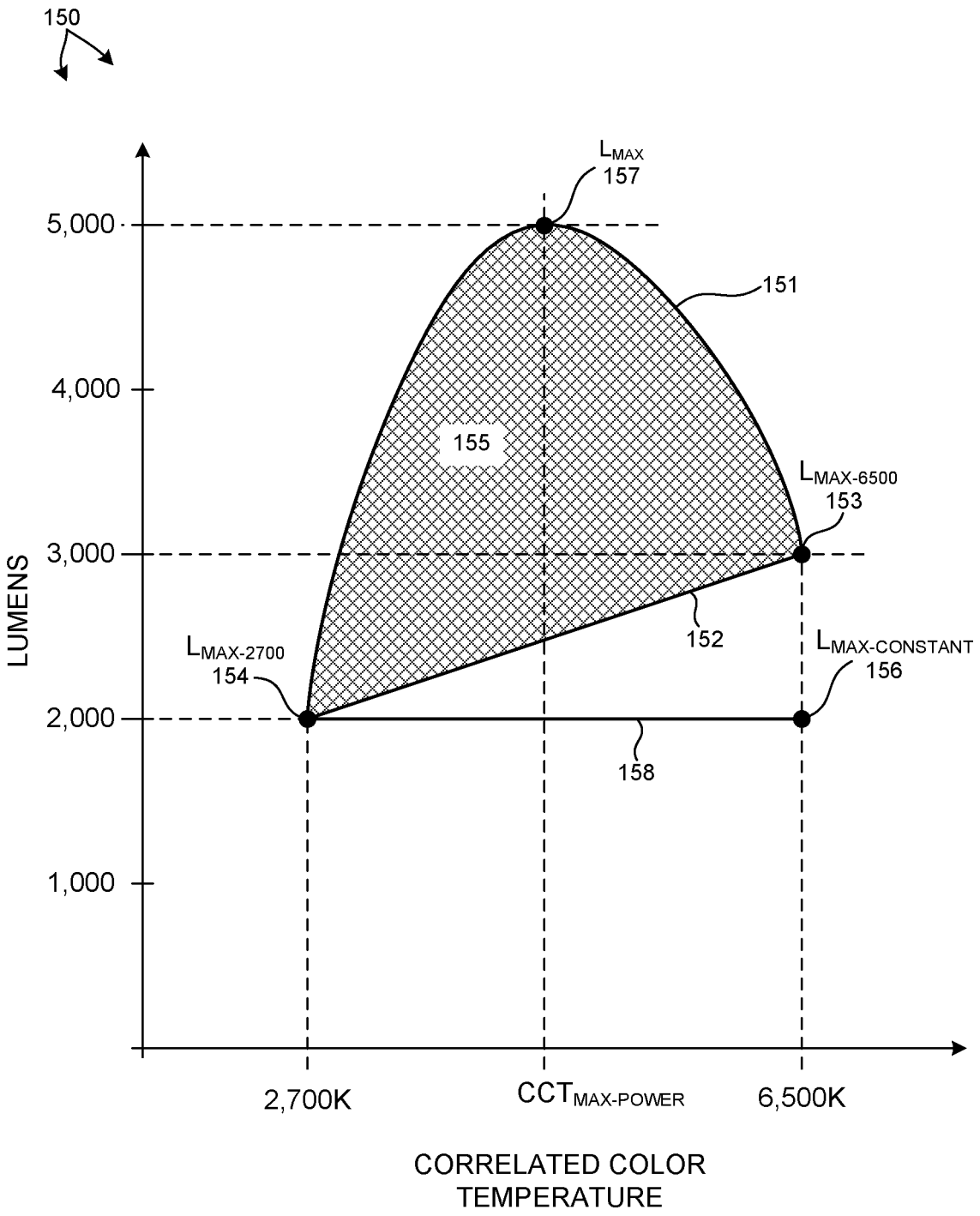
FIG. 4 depicts a plot 150 illustrative of achievable ranges of lumen output and correlated color temperature (CCT) from an exemplary multiple channel LED based illumination device including an independent, multiple channel LED driver.

FIG. 4 depicts a plot 150 illustrative of achievable ranges of lumen output and correlated color temperature (CCT) from an exemplary multiple channel LED based illumination device including an independent, multiple channel LED driver. As depicted in FIG. 4, an LED based illumination system includes a warm colored LED string that emits light at 2,700K and a cool colored LED string that emits light at 6,500K. The maximum lumen output of the warm LED string is 2,000 lumens (depicted as $L_{MAX\text{-}2700}$ color point 154) at a rated maximum continuous operating current of 400 milliamps, and the maximum lumen output of the cool LED string is 3,000 lumens (depicted as $L_{MAX\text{-}6500}$ color point 153) at a rated maximum continuous operating current of 400 milliamps.

Line 152 is referred to as a constant power line. This line is an illustration of achievable CCT values and brightness values when operating the LED strings in a constant power mode (i.e., the sum of current flow through the warm and cool LED strings is a constant value). For example, $L_{MAX\text{-}2700}$ color point 154 is achieved when the warm LED string is operated at 400 milliamps and the cool LED string is operated at zero milliamps. Similarly, $L_{MAX\text{-}6500}$ color point 153 is achieved when the warm LED string is operated at zero milliamps and the cool LED string is operated at 400 milliamps. All points along line 152 are achieved by operating the warm LED string and cool LED string at different combinations of current levels that each sum to 400 milliamps.

Line 158 is referred to as a constant lumen line. This line is an illustration of achievable CCT values and brightness values when operating the LED strings in a constant lumen mode (i.e., the sum lumen output of the warm and cool LED strings is a constant value). For example, $L_{MAX\text{-}2700}$ color point 154 is achieved when the warm LED string is operated at 400 milliamps and the cool LED string is operated at zero milliamps. $L_{MAX\text{-}CONSTANT}$ color point 156 is achieved when the warm LED string is operated at zero milliamps and the cool LED string is operated at significantly less than 400 milliamps. All points along line 152 are achieved by operating the warm LED string and cool LED string at different combinations of current levels that result in a combined lumen output of 2,000 lumens.

Figure 1:
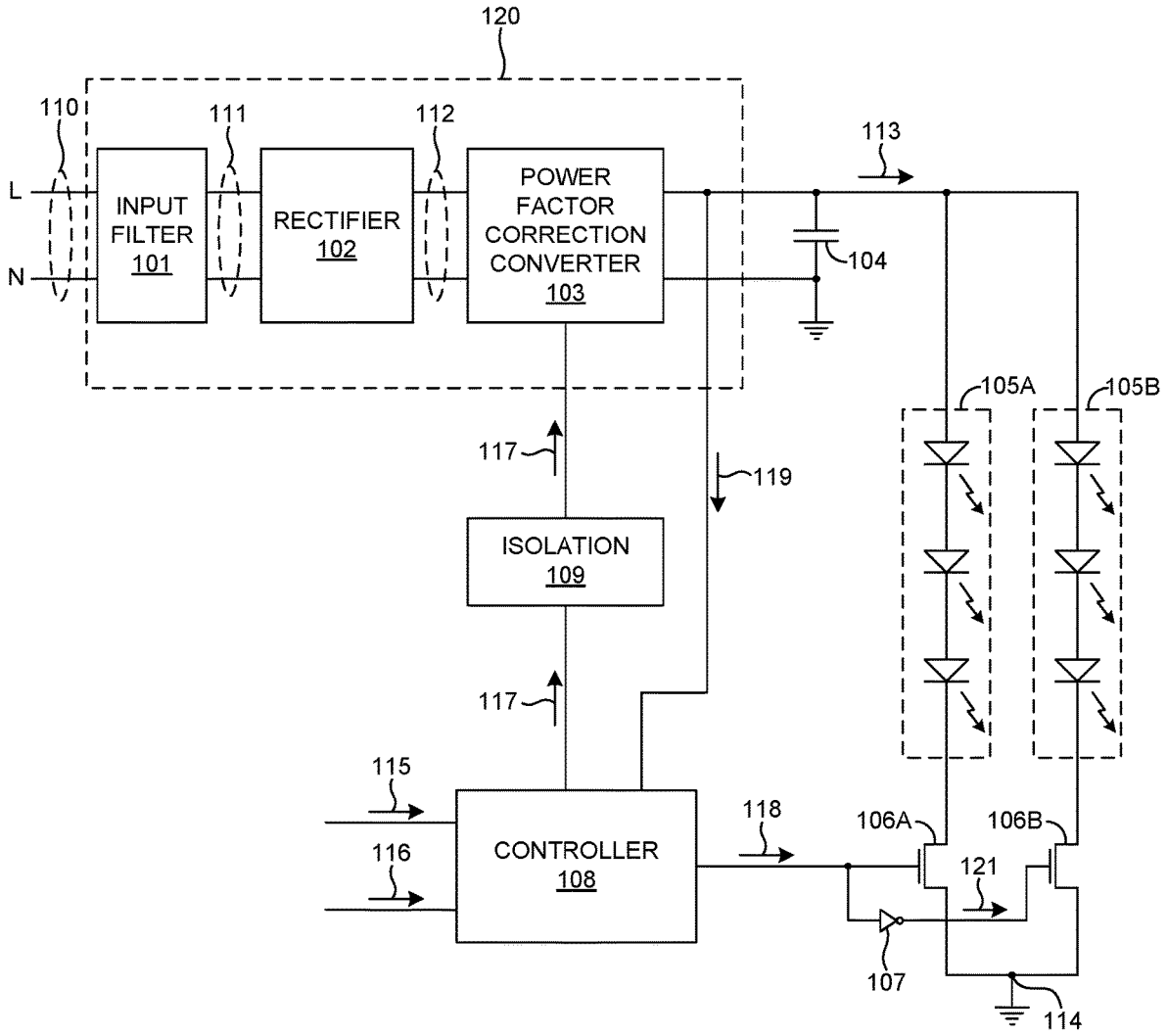
(PRIOR ART) FIG. 1
FIG. 1 is a diagram illustrative of a traditional multichannel LED driver in one embodiment.

In general, traditional multichannel current drivers, such as those described with reference to FIGS. 1 and 2, are able to control CCT and brightness levels at or below the constant power line. However, these traditional drivers cannot control CCT and brightness levels above the constant power line because traditional drivers are unable to drive current through both LED strings, simultaneously.

In a further aspect, the use of independent DC/DC power converters as described herein enables current to be supplied to each LED string simultaneously up to the rated maximum continuous operating current level in each LED channel (e.g., LED string). Thus, the sum of the current provided to each LED channel exceeds the rated maximum continuous operating current of each of the LED channels. In one example, the sum of the current provided to a first LED channel (e.g., first string of LEDs) and the current provided to a second LED channel (e.g., second string of LEDs) exceeds both the rated maximum continuous operating current of the first LED channel and the rated maximum continuous operating current of the second LED channel.

Line 151 is referred to as a maximum power line. This line is an illustration of achievable CCT values and brightness values when operating either one, or both of the LED strings at maximum current. For example, color point $L_{MAX}$ 157 is achieved when the warm LED string is operated at 400 milliamps and the cool LED string is operated at 400 milliamps. In this example, the combined lumen output is 5,000 lumens at a color temperature value, $CCT_{MAX\text{-}POWER}$. For color points below $CCT_{MAX\text{-}POWER}$ along the maximum power line, the warm LED string is operated at 400 milliamps (i.e., rated maximum continuous operating current) and the cool LED string is operated at less than 400 milliamps (i.e., less than rated maximum continuous operating current). Conversely, for color points above $CCT_{MAX\text{-}POWER}$ along the maximum power line, the cool LED string is operated at 400 milliamps (i.e., rated maximum continuous operating current) and the warm LED string is operated at less than 400 milliamps (i.e., less than rated maximum continuous operating current). At all points along the maximum power line, the sum of the currents flowing through the warm and cool LED strings exceeds the rated maximum continuous operating current of the individual LED strings (e.g., greater than 400 milliamps). In fact, to realize overall brightness and CCT at any of the points within the area 155 marked by hatching requires that the sum of the currents flowing through the warm and cool LED strings exceeds the rated maximum continuous operating current of the LED strings, individually. As such, overall brightness and CCT targets within the area 155 are achievable with a multiple channel electrical power driver as described herein, but not with a traditional multichannel driver.

In another further aspect, a multiple channel electrical power driver is configured to control the combined light generated by multiple, different white colored LED strings in one of a number of different control modes.

As depicted in FIG. 3, controller 144 receives a digital mode selection signal 143. The value of the digital mode selection signal dictates the mode in which controller 144 operates.

In one example, controller 144 operates in an unconstrained mode. In this mode, controller 144 determines the values of the current command signals 141A and 141B based on the brightness command signal 115 and color command signal 116 using the look-up table stored in memory 145. In this mode, controller 144 determines values of current command signals 141A and 141B to realize any desired brightness and CCT within the space under the maximum power curve 151.

In another example, controller 144 operates in a constant power mode. In this mode, controller 144 determines the ratio of the current command signals 141A and 141B based on the value of the CCT command signal 116 and the sum of the current command signals 141A and 141B based on the brightness command signal 115. In this mode, controller 144 determines values of current command signals 141A and 141B to realize any desired brightness and CCT within the space under the constant power curve 152.

In another example, controller 144 operates in a constant lumen mode. In this mode, controller 144 determines the ratio of the current command signals 141A and 141B based on the value of the CCT command signal 116 and the sum of the current command signals 141A and 141B based on the brightness command signal 115. In this mode, controller 144 determines values of current command signals 141A and 141B to realize any desired brightness and CCT within the space under the constant lumen curve 156.

In another example, controller 144 operates in a dim to warm mode. In this mode, controller 144 determines the values of current command signals 141A and 141B based on the value of the brightness command signal 115. In one example, the values of current command signals 141A and 141B are determined using the look-up table stored in memory 145. In this example, controller 144 determines values of current command signals 141A and 141B to realize the desired brightness value at a predetermined CCT value. The predetermined CCT value is a function (e.g., linear or non-linear function) of the desired brightness. In some examples, the functional relationship between CCT and brightness mimics daylight. During the day sunlight appears cooler at peak brightness (e.g., middle of the day) and warmer at waning brightness levels (e.g., sunrise and sunset).

In another example, controller 144 operates in a time of day mode. In this mode, controller 144 determines values of current command signals 141A and 141B to realize a desired brightness value at a predetermined CCT value. The predetermined CCT value is a function (e.g., linear or non-linear function) of the time of day and calendar date or time of day, calendar date, and physical location. In one example, controller 144 includes a real time clock that tracks the time of day and calendar date. In addition, controller 144 may store an indication of the longitude and latitude of its physical location. In some examples, controller 144 stores a function or look-up table that maps time of day and calendar date to desired CCT. In some other examples, controller 144 stores a function or look-up table that maps time of day, calendar date, and physical location to desired CCT. In some examples, the values of current command signals 141A and 141B are determined using a look-up table stored in memory 145 of controller 144 to realize the desired brightness indicated by the value of the brightness command signal 115 and the desired CCT determined based on the time of day.

Figure 7:
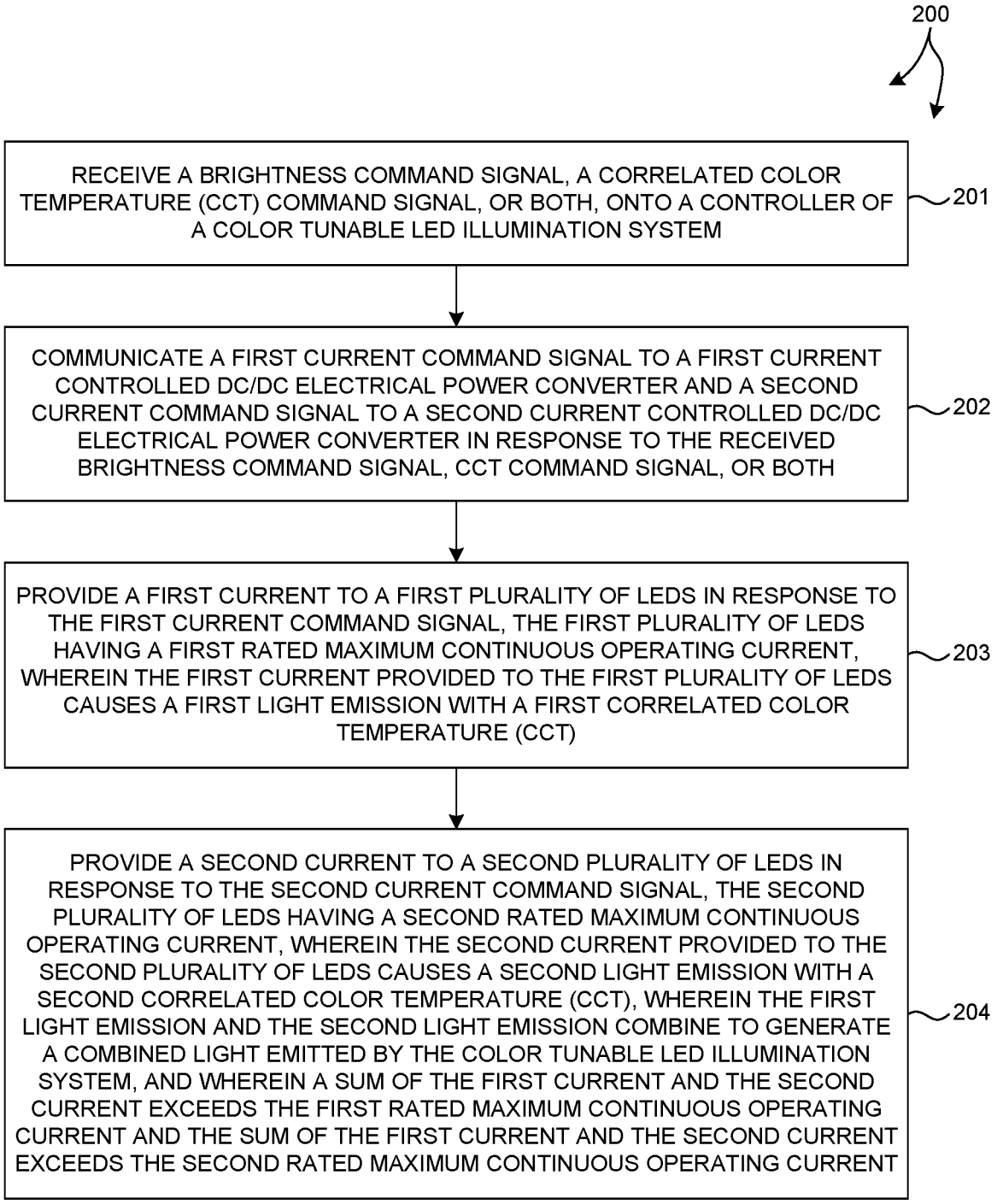
FIG. 7 depicts a flowchart illustrative of a method for controlling a multiple channel LED based illumination device in at least one novel aspect.

FIG. 7 illustrates a method 200 suitable for implementation by the independent, multiple channel LED driver of the present invention. In one aspect, it is recognized that data processing blocks of method 200 may be carried out via a pre-programmed algorithm executed by one or more processors of controller 144. While the following description is presented in the context of the independent, multiple channel LED driver systems described herein, it is recognized herein that the particular structural aspects of the described systems do not represent limitations and should be interpreted as illustrative only.

In block 201, a brightness command signal, a correlated color temperature (CCT) command signal, or both, is received onto a controller of a color tunable LED illumination system.

In block 202, a first current command signal is communicated to a first current controlled DC/DC electrical power converter and a second current command signal is communicated to a second current controlled DC/DC electrical power converter in response to the received brightness command signal, CCT command signal, or both.

In block 203, a first current is provided to a first plurality of LEDs in response to the first current command signal. The first plurality of LEDs has a first rated maximum continuous operating current. The first current provided to the first plurality of LEDs causes a first light emission with a first Correlated Color Temperature (CCT).

In block 204, a second current is provided to a second plurality of LEDs in response to the second current command signal. The second plurality of LEDs has a second rated maximum continuous operating current. The second current provided to the second plurality of LEDs causes a second light emission with a second Correlated Color Temperature (CCT). The first light emission and the second light emission combine to generate a combined light emitted by the color tunable LED illumination system. A sum of the first current and the second current exceeds the first rated maximum continuous operating current and the sum of the first current and the second current exceeds the second rated maximum continuous operating current.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An LED based illumination device, comprising:

a first LED string comprising a first plurality of LEDs coupled in series, the first LED string having a first rated maximum continuous operating current, wherein a first current provided to the first LED string causes a first light emission with a first Correlated Color Temperature (CCT);

a second LED string comprising a second plurality of LEDs coupled in series, wherein a second current provided to the second LED string causes a second light emission with a second CCT, the second LED string having a second rated maximum continuous operating current, wherein the first light emission and the second light emission combine to generate a combined light emitted by the LED based illumination device;

a first current controlled Direct Current/Direct Current (DC/DC) electrical power converter electrically coupled to the first LED string, the first current controlled DC/DC electrical power converter configured to provide the first current to the first LED string in response to a first current command signal;

a second current controlled DC/DC electrical power converter electrically coupled to the second LED string, the second current controlled DC/DC electrical power converter configured to provide the second current to the second LED string in response to a second current command signal; and a controller configured to receive a brightness command signal, a correlated color temperature (CCT) command signal, or both, and communicate the first current command signal to the first current controlled DC/DC electrical power converter and the second current command signal to the second current controlled DC/DC electrical power converter, wherein a sum of the first current and the second current exceeds the first rated maximum continuous operating current and the sum of the first current and the second current exceeds the second rated maximum continuous operating current: and an amount of memory storing a look-up table mapping values of the brightness command signal and values of the correlated color temperature (CCT) command signal to values of the first current command signal and the second current command signal, a mathematical function mapping values of the brightness command signal and values of the correlated color temperature (CCT) command signal to values of the first current command signal and the second current command signal, or both.

2. The LED based illumination device of claim 1, further comprising:

a voltage controlled Alternating Current/Direct Current (AC/DC) electrical power converter electrically coupled to the first and second current controlled DC/DC electrical power converters, wherein the voltage controlled AC/DC electrical power converter provides electrical power to the first and second current controlled DC/DC electrical power converters.

3. The LED based illumination device of claim 1, wherein the first current is provided to the first LED string and the second current is provided to the second LED string simultaneously.

4. The LED based illumination device of claim 1, wherein the first current command signal and the second current command signal are analog signals, pulse width modulated (PWM) signals, or a combination thereof.

5. The LED based illumination device of claim 4, wherein the first current command signal is an analog signal when a desired value of the first current to be provided to the first LED string is above a predetermined threshold value and is a PWM signal when the desired value of the first current to be provided to the first LED string is below the predetermined threshold value.

6. The LED based illumination device of claim 1, wherein a CCT of the combined light emitted by the LED based illumination device is a predetermined function of a value of the brightness command signal.

7. The LED based illumination device of claim 1, wherein a CCT of the combined light emitted by the LED based illumination device is a predetermined function of a time of day of operation of the LED based illumination device.

8. The LED based illumination device of claim 1, wherein a sum of the first current and the second current is a constant value over a range of values of the correlated color temperature (CCT) command signal.

9. The LED based illumination device of claim 1, wherein the first current is the first rated maximum continuous operating current and the second current is the second rated maximum continuous operating current at a value of CCT associated with maximum lumen output from the first and second LED strings.

10. An apparatus comprising:

a first current controlled Direct Current/Direct Current (DC/DC) electrical power converter electrically coupleable to a first set of one or more light emitting diodes (LEDs), the first set of LEDs having a first rated maximum continuous operating current, the first current controlled DC/DC electrical power converter configured to provide a first current to the first set of LEDs in response to a first current command signal, wherein the first set of LEDs emit light with a first Correlated Color Temperature (CCT) in response to the first current;

a second current controlled DC/DC electrical power converter electrically coupleable to a second set of one or more LEDs, the second set of LEDs having a second rated maximum continuous operating current, the second current controlled DC/DC electrical power converter configured to provide a second current to the second set of LEDs in response to a second current command signal, wherein the second set of LEDs emit light with a second Correlated Color Temperature (CCT) in response to the second current, wherein the first light emission and the second light emission combine to generate a combined light emitted by a LED based illumination device; and a controller configured to communicate the first current command signal to the first current controlled DC/DC electrical power converter and the second current command signal to the second current controlled DC/DC electrical power converter based on a brightness command signal, a correlated color temperature (CCT) command signal, or both, received by the controller, wherein a sum of the first current and the second current exceeds the first rated maximum continuous operating current and the sum of the first current and the second current exceeds the second rated maximum continuous operating current: and an amount of memory storing a look-up table mapping values of the brightness command signal and values of the correlated color temperature (CCT) command signal to values of the first current command signal and the second current command signal, a mathematical function mapping values of the brightness command signal and values of the correlated color temperature (CCT) command signal to values of the first current command signal and the second current command signal, or both.

11. The apparatus of claim 10, wherein the first current command signal is an analog signal when a desired value of the first current to be provided to the first set of LEDs is above a predetermined threshold value and is a pulse width modulated (PWM) signal when the desired value of the first current to be provided to the first set of LEDs is below the predetermined threshold value.

12. The apparatus of claim 10, wherein a CCT of the combined light emitted by the LED based illumination device is a predetermined function of a value of the brightness command signal.

13. The apparatus of claim 10, wherein a CCT of the combined light emitted by the LED based illumination device is a predetermined function of a time of day of operation of the LED based illumination device.

14. A method comprising:

receiving a brightness command signal, a correlated color temperature (CCT) command signal, or both, onto a controller of a color tunable LED illumination system;

communicating a first current command signal to a first current controlled DC/DC electrical power converter and a second current command signal to a second current controlled DC/DC electrical power converter in response to the received brightness command signal, CCT command signal, or both;

providing a first current to a first plurality of LEDs in response to the first current command signal, the first plurality of LEDs having a first rated maximum continuous operating current, wherein the first current provided to the first plurality of LEDs causes a first light emission with a first Correlated Color Temperature (CCT); and providing a second current to a second plurality of LEDs in response to the second current command signal, the second plurality of LEDs having a second rated maximum continuous operating current, wherein the second current provided to the second plurality of LEDs causes a second light emission with a second Correlated Color Temperature (CCT), wherein the first light emission and the second light emission combine to generate a combined light emitted by the color tunable LED illumination system, and wherein a sum of the first current and the second current exceeds the first rated maximum continuous operating current and the sum of the first current and the second current exceeds the second rated maximum continuous operating current: and mapping values of the brightness command signal and values of the correlated color temperature (CCT) command signal to values of the first current command signal and the second current command signal by a look-up table, mathematical function, or both.

* * * * *